US008820484B2

(12) United States Patent
Rui

(10) Patent No.: US 8,820,484 B2
(45) Date of Patent: Sep. 2, 2014

(54) CIRCUITS AND METHODS FOR CONTROLLING ELEVATOR BRAKING SYSTEM

(75) Inventor: Zhenpu Rui, Shijiazhuang (CN)

(73) Assignee: Shijiazhuang Wulon Brake Co., Ltd, Shijiazhuang, Hebei Province (CN)

( * ) Notice: Subject to any disclaimer, the term of this patent is extended or adjusted under 35 U.S.C. 154(b) by 594 days.

(21) Appl. No.: 13/140,362

(22) PCT Filed: Mar. 20, 2009

(86) PCT No.: PCT/CN2009/070899

§ 371 (c)(1),
(2), (4) Date: Jun. 16, 2011

(87) PCT Pub. No.: WO2010/102458

PCT Pub. Date: Sep. 16, 2010

(65) Prior Publication Data

US 2011/0240411 A1 Oct. 6, 2011

(30) Foreign Application Priority Data

Mar. 12, 2009 (CN) ..... 2009 1 0073910

(51) Int. Cl.
*B66B 1/34* (2006.01)

(52) U.S. Cl.
USPC ..... 187/288; 187/391

(58) Field of Classification Search
CPC ..... B66B 1/32
USPC ..... 187/247, 288, 391, 393; 361/2, 3, 5, 361/8–10, 13
See application file for complete search history.

(56) References Cited

U.S. PATENT DOCUMENTS

| | | | | |
|---|---|---|---|---|
| 3,561,571 | A * | 2/1971 | Gingrich | 187/387 |
| 3,743,056 | A * | 7/1973 | Zitelli et al. | 187/394 |
| 4,114,730 | A * | 9/1978 | Means et al. | 187/247 |
| 4,721,188 | A * | 1/1988 | Araki et al. | 187/296 |
| 5,107,964 | A * | 4/1992 | Coste et al. | 187/280 |
| 5,717,174 | A * | 2/1998 | Ramos | 187/288 |
| 5,900,597 | A * | 5/1999 | Fernkas | 187/297 |
| 6,173,814 | B1 * | 1/2001 | Herkel et al. | 187/288 |
| 7,374,020 | B2 * | 5/2008 | Smith et al. | 187/289 |
| 8,584,812 | B2 * | 11/2013 | Dorsch et al. | 187/393 |
| 2013/0112507 | A1 * | 5/2013 | Marvin | 187/289 |

FOREIGN PATENT DOCUMENTS

| | | |
|---|---|---|
| CN | 101128379 | 2/2008 |
| CN | 201089681 | 7/2008 |
| CN | 101492138 | 7/2009 |
| GB | 779140 | 7/1957 |

* cited by examiner

*Primary Examiner* — Anthony Salata
(74) *Attorney, Agent, or Firm* — Hamre, Schumann, Mueller & Larson. P.C.

(57) ABSTRACT

Circuits and methods for controlling an elevator braking system are provided. A circuit for controlling an elevator braking system includes a contracting brake signal generating circuit, wherein a door lock relay DJ and a contracting brake contractor ZJ are series connected; a contracting brake signal processing circuit, for converting between high and low level to trigger a braking controller; and an isolation control switch CK jointly connected in the contracting brake signal generating circuit and the contracting brake signal processing circuit.

6 Claims, 2 Drawing Sheets

CIRCUITS AND METHODS FOR CONTROLLING ELEVATOR BRAKING SYSTEM

BACKGROUND OF THE INVENTION

1. Technical Field

The present invention relates to a control circuit and a control method of electromagnets, and more particularly, to a control circuit and a control method of elevator braking systems.

2. Description of Related Art

With the rapid development of electronic science and technology, the elevator technology has advanced rapidly as well. Specially, after being upgraded for several generations, the drive technology and control technology have evolved to permanent magnet synchronous speed regulation and microcomputer-based fully intelligent control respectively, which can enhance the reliability and stability of the complete machine. However, the brake control circuit (also referred to as contracting brake circuit), one of the major work circuits of elevators, is always designed in a conventional way.

In recent years, as the use of elevators increases sharply, the number of elevator induced safety accidents is on the increase as well. The brake fault induced accidents account for 80% of the total number of the accidents. In addition to mechanical faults, one major contributor to the brake fault is adhesion of contacts of switches of elevator braking systems, which leads to the inability of brakes to brake. The underlying cause leading to adhesion of contacts of switches is that the brake excitation coils are series connected in the contracting brake circuit thereby resulting in excessively large current flowing through the contacts of switches. Also, the continuous current of the brake excitation coil flows through the contacts of switches as well. As a result, the contracting brake circuit of the existing elevator braking systems cannot address the problem of such adhesion of the contacts of switches.

Substantially, the contracting brake circuit of the existing elevator braking systems falls into the categories as follows: 1. the contracting brake circuit that utilizes a current limiting resistance to achieve the switching between excitation voltage and holding voltage of the brake excitation coil; 2. the contracting brake circuit in which an arc quenching circuit is installed at the voltage switching contacts in order to increase the service life of the contacts; and 3. the contracting brake circuit that utilizes a rectifier diode to achieve the full-wave/half-wave rectification switching between the excitation voltage and holding voltage of the brake excitation coil.

In a typical contracting brake circuit as shown in FIG. 1, an operating contactor CJ, a door lock relay DJ, an economy resistance R, a contracting brake contactor ZJ and a brake excitation coil L are series connected after a full-wave rectification circuit D1-D4. A switch K is parallel connected across the economy resistance R, serving to achieve the switching between the excitation voltage and holding voltage.

In the contracting brake circuit, since the switching devices are connected in series with the brake excitation coil L, the excitation current flowing through the contracting brake circuit can normally be as high as several amperes. At the moment when the switch K is opened, the continuous current of the brake excitation coil L will flow through the diodes D3, D4 of the full-wave rectification circuit, which, along with the switch K, form a circuit. This will lead to arcing of the contacts of the switch.

In the full wave/half wave rectification voltage switching type contracting brake circuit as shown in FIG. 2, although the continuous current of the brake excitation coil L will not flow through the switch K, as the switch K is opened at any time randomly, when the switching occurs at the time when the current flowing through the brake excitation coil L reaches the maximum, the contacts of the switch K will be subject to the most severe arcing condition. In the event of adhesion of the contacts of the switch K, the brake will not be able to brake, causing the failure of the elevator braking system, and consequently, the major safety accidents such as the elevator slipping, overrunning or collapsing to the bottom.

BRIEF SUMMARY OF THE INVENTION

Technical Problem

The adhesion of contacts of contracting brake circuits of the existing elevator braking systems.

Technical Solution

The objective of the present invention is to provide a control circuit and a control method of elevator braking systems, which can fundamentally eliminate the problem of adhesion of contacts of contracting brake circuits, thereby improving the safety and stability of elevators during operation.

The control circuit of elevator braking systems of the present invention is implemented as follows:

A control circuit of elevator braking systems, comprising:

a contracting brake signal generating circuit, wherein a door lock relay DJ and a contracting brake contactor ZJ for issuing contracting brake/releasing brake commands are series connected;

a contracting brake signal processing circuit for receiving contracting brake/releasing brake command signals and issuing the same to a braking controller; and an isolation control switch CK which is jointly connected in the contracting brake signal generating circuit and the contracting brake signal processing circuit, for controlling the contracting brake signal processing circuit to convert between high and low level in response to command signals from the contracting brake signal generating circuit.

The contracting brake signal processing circuit is a level conversion circuit, with one end thereof being connected to a DC power supply, an immediate part thereof being series connected with a current limiting resistance and the other end thereof being connected to a grounding line G; a control signal output line C for connecting the braking controller is connected at one node of the circuit.

The isolation control switch CK is of a type selected from a group consisting of a bidirectional photoelectric coupler, a voltage converter, a transformer and a relay.

Also, an operating contactor CJ may be series connected in the contracting brake signal processing circuit.

The design philosophy of the control circuit of the present invention is that the brake excitation coil is excluded from the contracting brake circuit in which the devices essential for safe operation of elevators comprising the door lock relay DJ, the operating contactor CJ are series connected with the contracting brake command setting devices comprising the contracting brake contactor ZJ such that the brake excitation coil is directly connected with and controlled by the braking controller. After the contracting brake signal generating circuit issues a contracting brake or releasing brake command signal, the contracting brake signal processing circuit will in response thereto send a level signal compatible with TTL circuits or CMOS gate circuits, causing the braking controller to operate. The braking controller can then excite the power supply of the excitation coil to be on or off, thereby achieving the brake contracting or releasing operations.

The control method of the elevator braking system of the present invention is implemented as follows:

A control method of elevator braking systems, comprising:

providing a contracting brake signal generating circuit, wherein a door lock relay DJ and a contracting brake contactor ZJ for issuing contracting brake/releasing brake commands are series connected;

providing a contracting brake signal processing circuit for receiving contracting brake/releasing brake command signals and issuing the same to a braking controller; and providing an isolation control switch CK which is jointly connected in the contracting brake signal generating circuit and the contracting brake signal processing circuit, for controlling the contracting brake signal processing circuit to convert between high and low level in response to command signals from the contracting brake signal generating circuit.

The contracting brake signal processing circuit is a level conversion circuit, with one end thereof being connected to a DC power supply, an immediate part thereof being series connected with a current limiting resistance and the other end thereof being connected to a grounding line G; a control signal output line C for connecting the braking controller is connected at one node of the circuit.

The isolation control switch CK is of a type selected from a group consisting of a bidirectional photoelectric coupler, a voltage converter, a transformer and a relay.

Also, an operating contactor CJ may be series connected in the contracting brake signal processing circuit as well. If it is desirable to connect the operating contactor CJ in the power supply circuit of the braking controller, the operating contactor CJ is eliminated from the contracting brake signal processing circuit.

Advantageous Effects

With the design and use of the control circuit of the present invention, the contracting brake signal generating circuit that is equivalent to a contracting brake circuit can be separated from the brake excitation coil. As a result, the contracting brake signal generating circuit requires only several tens of milliamperes of operating current. This can effectively avoid arcing of the contacts of the contracting brake circuit caused by excessively large current, thereby eliminating the problem of adhesion of the contacts of the contracting brake circuits, and, consequently, improving the operating safety of the elevator braking system and the safety of the elevators during operation.

Through the use of the control method of the elevator braking system of the present invention, the current flowing through the brake excitation coil is independent of the contracting brake circuit since the braking controller simply extract signals from the contracting brake signal generating circuit and the contracting brake signal processing circuit. Consequently, when the brake excitation coil is separated from the contracting brake circuit, the current flowing through the contracting brake circuit will be declined significantly from the original several amperes to several tens of milliamperes. This can address the technical problem of adhesion of the contacts of the contracting brake circuits thereby improving the safety of the elevator braking system and the safety of the elevators during operation. Moreover, the application of the control circuit and the control method of the present invention can reduce the power consumption of the brakes by more than 75% as compared to the conventional brakes of similar size.

DETAILED DESCRIPTION OF THE INVENTION

Figure 1:
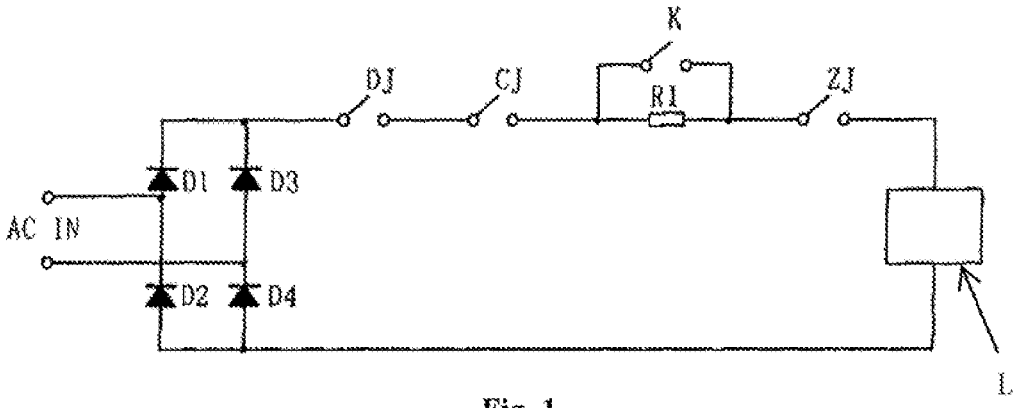
FIGS. 1 and 2 are electrical schematic diagrams of two contracting brake circuits of elevator braking systems of the prior art.
Figure 2:
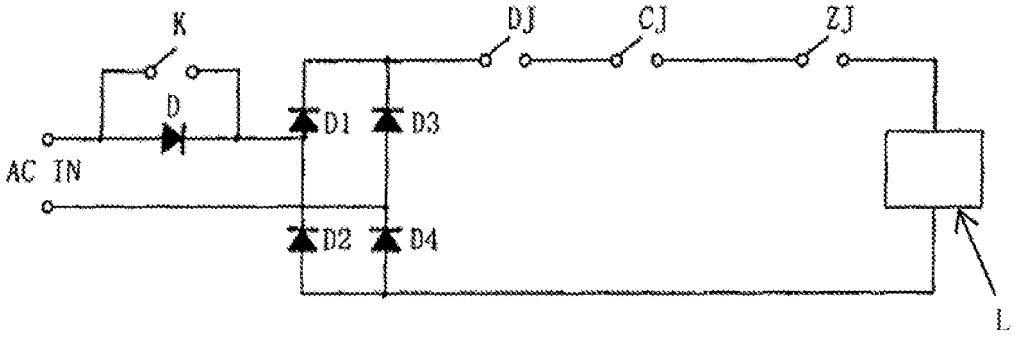
Figure 3:
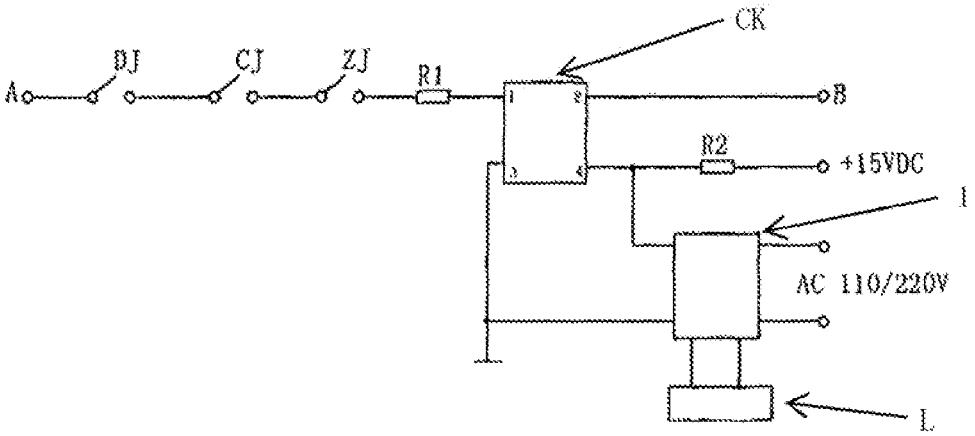
FIG. 3 is an electrical schematic diagram of a control circuit of the present invention.

As shown in FIG. 3, the control circuit of the present invention comprises a contracting brake signal generating circuit, a contracting brake signal processing circuit and an isolation control switch CK.

In the contracting brake signal generating circuit, a door lock relay DJ, an operating contactor CJ, a contracting brake contactor ZJ and a current limiting resistance R1 are series connected. The A, B terminals of the circuit are connected with a 110V/220V AC power supply.

The contracting brake signal processing circuit is a DC level conversion circuit, with one end thereof being connected to a 15V DC power supply, an immediate part thereof being series connected with a current limiting resistance R2 and the other end thereof being connected to a grounding line G. A control signal output line C for connecting a braking controller 1 is connected after the current limiting resistance R2 at one node of the circuit. The brake excitation coil L is connected with the braking controller 1 which is powered by a 110V/220V AC power supply.

The isolation control switch CK is a bidirectional photoelectric coupler OPT having its forward and backward light-emitting diodes respectively series connected in the contracting brake signal generating circuit, and its light receiving tube series connected before the terminal of the grounding line G in the contracting brake signal processing circuit.

Figure 4:
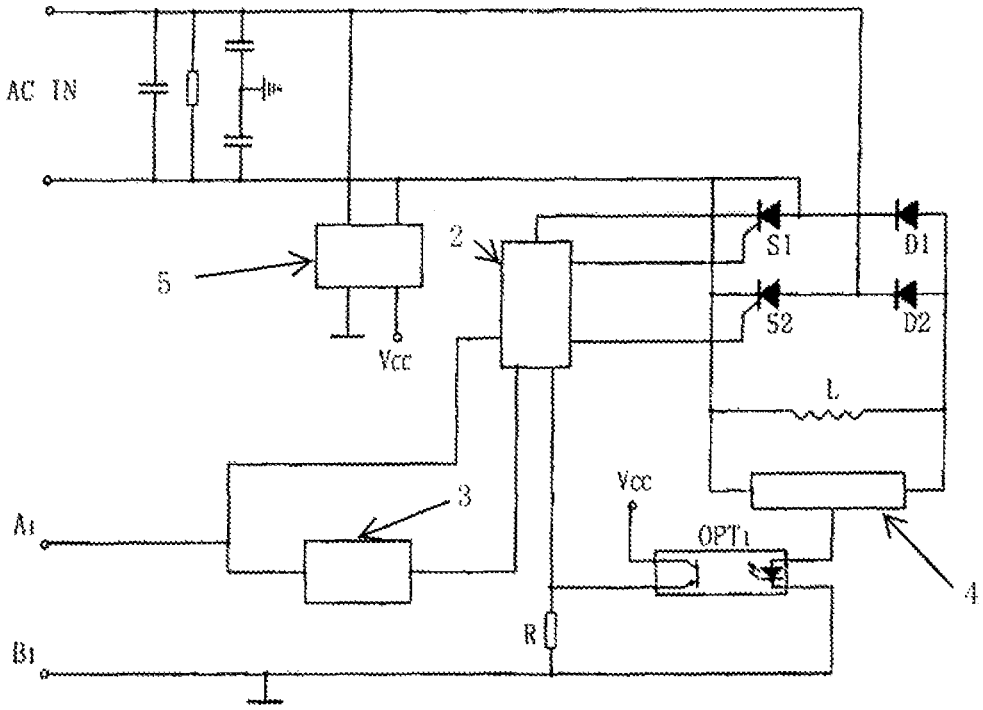
FIG. 4 is an electrical schematic diagram of an embodiment of a braking controller according to the prevent invention.

The braking controller 1 that is connected with a control signal output line C of the contracting brake signal processing circuit may be implemented as an assorted circuit configuration as shown in FIG. 4.

In the braking controller, the load connected with the single-phase half-controlled bridge rectification circuit is the brake excitation coil L and the controlled silicon trigger circuit is implemented as a voltage-controlled phase shifter 2 with voltage feedback. The single-phase half-controlled bridge rectification circuit can output an adjustable brake coil excitation voltage and an adjustable and stable brake coil holding voltage. When the network voltage fluctuates, it can still supply a stable DC holding voltage for the brake excitation coil L, maintaining the holding force of the brake at a constant value. Therefore, the brake can provide a sufficient braking force, allowing for low power consumption, low temperature rise and large thrust of the brake.

In the braking controller, the single-phase half-controlled bridge rectification circuit has its main power supply directly connected with the network voltage and is put into standby mode once the elevator is power on. The signal input terminals A1, B1 of the single-phase half-controlled bridge rectification circuit are respectively connected with the control signal output line C and the grounding terminal of the contracting brake signal processing circuit of the control circuit of the present invention. The voltage output terminals of the single-phase half-controlled bridge rectification circuit are directly connected with the brake excitation coil L at both ends.

The brake excitation coil L may be either one set of coil or two or more than two sets of coil and may either be series connected or parallel connected.

Since in the control circuit of the present invention the current flowing through the brake excitation coil L is independent of the contracting brake circuit, the current load of the contracting brake circuit is mitigated, improving the reliability of all the mechanical contact switches of the contracting brake circuit The operating principle of the elevator braking system is described hereinafter.

The closing of both the door lock relay DJ and the operating contactor CJ that are series connected in the contracting brake signal generating circuit as shown in FIG. 3 is the sufficient condition for brake releasing of the elevator braking system. If the contracting brake contactor ZJ is controlled to be closed at this time, the necessary condition for brake releasing of the elevator braking system is satisfied. At this time, the pins 1, 2 of the bidirectional photoelectric coupler acting as the isolation control switch CK is power on and the pins 3, 4 of the same output a low level. As shown in FIG. 4, one low level is transmitted to trigger the voltage-controlled phase shifter 2 to operate and the other is transmitted to the excitation holding circuit 3 that causes the voltage-controlled phase shifter 2 to operate at the excitation phase shift voltage setting for a duration of 0.8 seconds. Thereafter, the circuit automatically switches to the holding voltage output state. The output voltage of the single-phase half-controlled bridge rectification circuit is then sampled by the voltage sampling circuit 4 and coupled to the voltage input terminal of the voltage-controlled phase shifter 2. Depending upon the output voltage level, the voltage sampling feedback circuit 4 automatically adjusts the phase shifting angle of the voltage-controlled phase shifter to maintain the output voltage thereof stable. Until then, the elevator braking system completes a brake releasing operation.

The voltage-controlled phase shifter 2 uses an internal power supply 5 to provide a 15V DC operating voltage.

Once any one of the switches that are closed and series connected in the contracting brake signal generating circuit is opened, the condition for the elevator braking system to brake is satisfied. At this time, the pins 3, 4 of the bidirectional photoelectric coupler acting as the isolation control switch CK output a high level, which on one hand causes the voltage-controlled phase shifter 2 to stop working, and on the other hand blocks the controlled silicon trigger circuit, thereby decreasing the output voltage of the single-phase half-controlled bridge rectification circuit to zero. This allows the brake to effect the contracting braking operation by means of the driving of the mechanical elastic component inside the brake. Until then, the braking controller 1 restores to the standby state, waiting for the next command.

Both the excitation voltage and holding voltage output from the braking controller 1 implemented for the control method of the present invention can be set through adjustment. When the AC input voltage is 220V, the voltage can be adjusted in the range of 0V to 198V. Generally, the excitation voltage and holding voltage output from the single-phase half-controlled bridge rectification circuit depends upon the magnitude of the thrust of the brake. When the input voltage of the single-phase half-controlled bridge rectification circuit is 220V, the excitation voltage is normally 40-70% of the full-wave rectification voltage and the holding voltage is normally 20-30% of the same. When the input voltage of the single-phase half-controlled bridge rectification circuit is 110V, the excitation voltage is normally 70-80% of the full-wave rectification voltage and the holding voltage is normally 40-50% of the same.

In the foregoing braking controller, the brake excitation coil circuit employs silicon-controlled contactless switches to perform voltage switching and voltage adjustment and control, thereby ensuring a high reliability of the main circuit of the elevator braking system. Moreover, since the holding voltage of the brake comes from a stable voltage output, the stability thereof during operation can be improved.

The invention claimed is:

1. A control circuit of elevator braking systems, comprising:

a contracting brake signal generating circuit, wherein a door lock relay DJ and a contracting brake contactor ZJ for issuing contracting brake/releasing brake commands are series connected;

a contracting brake signal processing circuit for receiving, contracting brake/releasing brake command signals and issuing the same to a braking controller; and an isolation control switch CK which is jointly connected in the contracting brake signal generating circuit and the contracting brake signal processing circuit, for controlling the contracting brake signal processing circuit to convert between high and low level in response to command signals from the contracting brake signal generating circuit;

wherein the contracting brake signal processing circuit is a level conversion circuit, with one end thereof being connected to a DC power supply, an immediate part thereof being series connected with a current limiting resistance and the other end thereof being connected to a grounding line G; a control signal output line C for connecting the braking controller is connected at one node of the circuit.

2. The control circuit of elevator braking systems as claimed in claim 1, wherein the isolation control switch CK is of a type selected from a group consisting of a bidirectional photoelectric coupler, a voltage converter, a transformer and a relay.

3. A control circuit of elevator braking systems as claimed in claim 1, wherein an operating contactor CJ is series connected in the contracting brake signal processing circuit.

4. A control method of elevator braking systems, comprising;

providing a contracting brake signal generating circuit, wherein a door lock relay DJ and a contracting brake contactor ZJ for issuing contracting brake/releasing brake commands are series connected;

providing a contracting brake signal processing circuit for receiving contracting, brake/releasing brake command signals and issuing the same to a braking controller; and providing an isolation control switch CK which is jointly connected in the contracting brake signal generating circuit and contracting brake signal processing circuit, for controlling the contracting brake signal processing circuit to convert between high and low level in response to command signals from the contracting brake signal generating circuit;

wherein the contracting brake signal processing circuit is a level conversion circuit, with one end thereof being connected to a DC power supply, and immediate part thereof being connected with a current limiting resistance R2 and the other end thereof being connected to a grounding line G; a control signal output line C for connecting the braking controller is connected at one node of the circuit.

5. The control method of elevator braking systems as claimed in claim 4, wherein the isolation control switch CK is of a type selected from a group consisting of a bidirectional photoelectric coupler, a voltage converter, a transformer and a relay.

6. The control method of elevator braking systems as claimed in claim 4, wherein an operating contactor CJ is series connected in the contracting brake signal processing circuit.

* * * * *